US007971448B2

(12) United States Patent
Kim et al.

(10) Patent No.: US 7,971,448 B2
(45) Date of Patent: Jul. 5, 2011

(54) AIR CONDITIONER

(75) Inventors: Seung Yup Kim, Seoul (KR); Byoung Chan Kim, Seoul (KR); Hyung Tae Kim, Seoul (KR); Dong Soo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/649,389

(22) Filed: Dec. 30, 2009

(65) Prior Publication Data

US 2010/0175407 A1 Jul. 15, 2010

(30) Foreign Application Priority Data

Jan. 9, 2009 (KR) ..... 10-2009-0001984

(51) Int. Cl.
*F25D 21/14* (2006.01)

(52) U.S. Cl. ..... 62/285; 62/291

(58) Field of Classification Search ..... 62/285, 62/513, 426, 419, 186, 291; 454/42, 188
See application file for complete search history.

(56) References Cited

U.S. PATENT DOCUMENTS 4,204,409 A * 5/1980 Satama ..... 62/271
4,321,803 A * 3/1982 Smith ..... 62/507
4,634,342 A * 1/1987 Rodewald ..... 415/211.2
4,815,530 A * 3/1989 Scott ..... 165/134.1
5,097,678 A * 3/1992 Aubuchon ..... 62/506
5,531,267 A * 7/1996 Ahmed et al. ..... 165/124
2005/0103038 A1 * 5/2005 Karkhanis ..... 62/305

FOREIGN PATENT DOCUMENTS

JP 2004125362 A 4/2004
JP 2006292196 A 10/2006
KR 2003034967 A 5/2003
KR 2006082335 A 7/2006

OTHER PUBLICATIONS

International Search Report issued in Application No. PCT/KR2009/007756, mailed Jul. 27, 2010, 2 pages.

* cited by examiner

*Primary Examiner* — Mohammad Ali
(74) *Attorney, Agent, or Firm* — Fish & Richardson P.C.

(57) ABSTRACT

An air conditioner includes a heat-exchanger positioned in an outdoor unit and configured to conduct heat-exchange between air provided from outside of the outdoor unit and a refrigerant. The air conditioner also includes a fan configured to generate a flow of the air that is from the heat-exchanger to an outlet of the outdoor unit. The air conditioner further includes a driving unit configured to provide a driving force to the fan. In addition, the air conditioner includes a first member positioned in the flow of the air generated by the fan and a second member configured to guide a flow of the air to reduce collision between the air and the first member when the fan is operated.

17 Claims, 4 Drawing Sheets

AIR CONDITIONER

CROSS-REFERENCE TO RELATED APPLICATIONS

The present application claims the benefits of priority to Korean Patent Application No. 10-2009-0001984 (filed on Jan. 9, 2009), which is hereby expressly incorporated by reference in its entirety.

FIELD

The present disclosure relates to an air conditioner.

BACKGROUND

In general, air conditioners are apparatuses that cool and/or heat air of an indoor space by heat-exchanging a refrigerant with indoor air and outdoor air. A split type air conditioner includes an indoor unit that cools and/or heats indoor air by heat-exchanging a refrigerant with the indoor air and an outdoor unit that cools and/or heats outdoor air by heat-exchanging a refrigerant with outdoor air.

The outdoor unit includes a blow fan for generating a flow of the outdoor air to exchange heat between the refrigerant circulating in an outdoor heat-exchanger and the outdoor air and a fan motor for driving the blow fan. The fan motor is fixedly mounted on a motor mount fixed by inside of the outdoor unit.

SUMMARY

In one aspect, an air conditioner includes a heat-exchanger positioned in an outdoor unit and configured to conduct heat-exchange between air provided from outside of the outdoor unit and a refrigerant. The air conditioner also includes a fan configured to generate a flow of the air that is from the heat-exchanger to an outlet of the outdoor unit. The air conditioner further includes a driving unit configured to provide a driving force to the fan. In addition, the air conditioner includes a first member positioned in the flow of the air generated by the fan and a second member configured to guide a flow of the air to reduce collision between the air and the first member when the fan is operated.

Implementations may include one or more of the following features. For example, the second member may be integrated with the first member. The first member may include a motor mount on which the driving unit is mounted. The second member is detachable and positioned on the first member.

In some implementations, the second member may be configured to change a flow path of air circulated by the fan. The second member may include a guide part and a hook part configured to be hooked on the first member.

In some examples, the second member may include a guide part having a V-shape and an extending part extending from a side of the guide part. The second member also may include a hook part extending from a side of the extending part and configured to be hooked on the first member. The air conditioner further may include a cooler configured to cool the refrigerant provided from the heat-exchanger.

The air conditioner further may include a drain member configured to collect condensed water resulting from the heat exchange performed by the heat-exchanger.

The air conditioner further may include a plurality of second members coupled to a plurality of first members, respectively, the plurality of second member being configured to guide a flow path of the air to reduce collision between the air and the plurality of first members.

In another aspect, an air conditioner includes a heat-exchanger positioned in an outdoor unit and configured to conduct heat-exchange between air provided from outside of the outdoor unit and a refrigerant. The air conditioner also includes a fan positioned above the heat-exchanger and configured to generate a flow of the air in which the air is flowed up toward an outlet of the outdoor unit of the air conditioner. The air conditioner further includes a driving unit configured to provide a driving force to the fan. In addition, the air conditioner includes a first member positioned in the flow of the air generated by the fan and a second member configured to guide a flow path of the air to reduce collision between the air and the first member when the fan is operated.

Implementations may include one or more of the following features. For example, the second member may be integrated with the first member. The first member may include a motor mount on which the driving unit is mounted. The second member may be detachable and positioned on the first member. The second member may include a guide part and a hook part configured to be hooked on the first member.

In some examples, the second member may include a guide part having a V-shape and an extending part extending from a side of the guide part. The air conditioner further may include a cooler configured to cool the refrigerant provided from the heat-exchanger.

In some implementations, the air conditioner further may include a drain member configured to collect condensed water resulting from the heat-exchange performed by the heat-exchanger. The air conditioner further may include a plurality of second members coupled to a plurality of first members, respectively, the plurality of second member being configured to guide a flow path of the air to reduce collision between the air and the plurality of first members.

BRIEF DESCRIPTION

DETAILED DESCRIPTION

Figure 1:
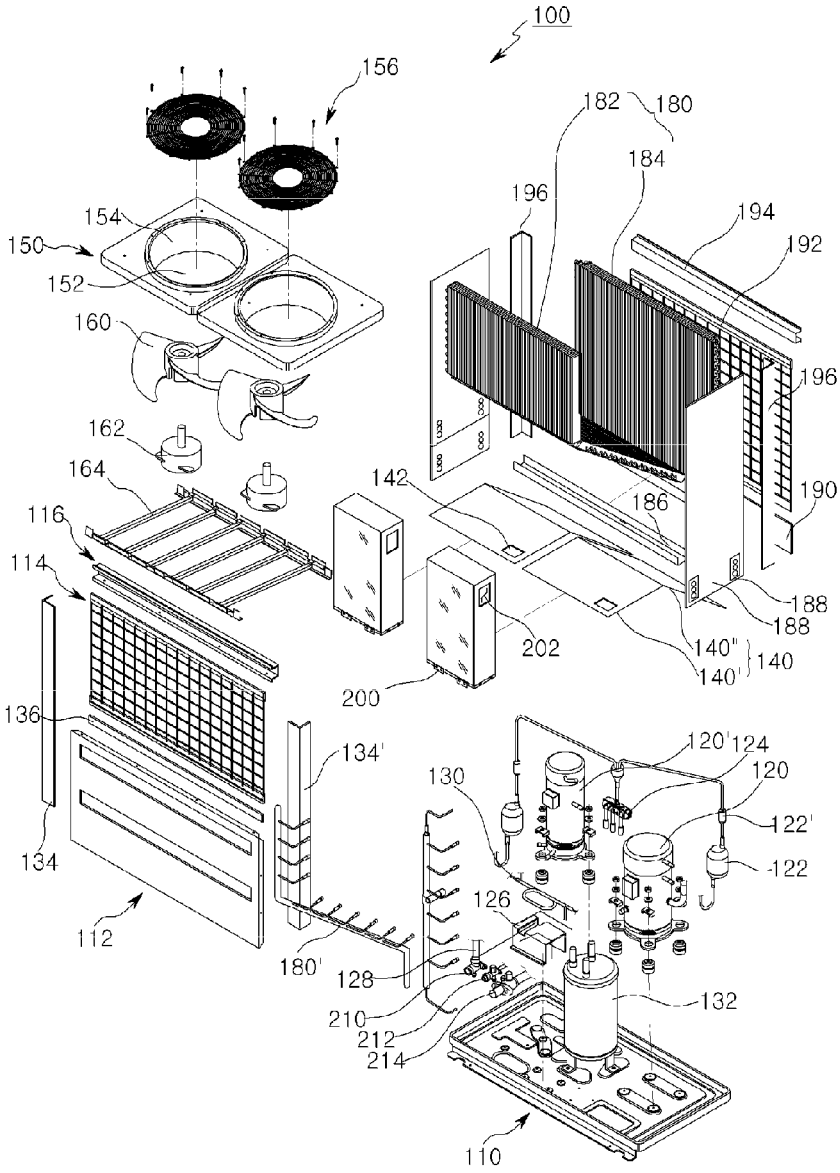
FIG. 1 is an exploded perspective view illustrating an outdoor unit of an air conditioner.

Referring to FIG. 1, a base fan 110 defines a bottom surface of an outdoor unit 100. A variety of parts, which will be described below, constituting a heat-exchanger are installed on a top surface of the base fan 110. A front panel 112 defining an outer appearance of a front portion is positioned on a front end of the base fan 110. A front grill 114 is positioned on an upper side of the front panel 112. Outdoor air is guided into the outdoor unit 110 through the front grill 114. The air in the outdoor unit 110 is provided to an outdoor heat-exchanger 180 to be heat-exchanged with a refrigerant. A front bracket 116 is positioned on an upper end of the front grill 114. A motor mount 164 is coupled to the front bracket 116.

Two compressors 120 and 120' are positioned on the top surface of the base fan 110. The compressors 120 and 120' compress the refrigerant into a high-pressure and high-temperature vapor refrigerant. In this implementation, for example, the compressor 120 is a regular velocity type compressor and the compressor 120' is an inverter type compressor 120'. The regular velocity compressor 120 may be positioned on a right portion of the top surface of the base fan 110. An inverter compressor 120', which is a variable speed heat pump, may be positioned on a left portion of the top surface of the base fan 110 as shown in FIG. 1.

Oil separators 122 are positioned at outlet sides of the regular velocity compressor 120 and the inverter compressor 120', respectively. The oil separators 122 filter oil contained in the refrigerant provided from the compressors 120 and 120'. The filtered refrigerant returns to the compressors 120 and 120'.

Check valves 122' are positioned at outlet sides of the oil separators 122, respectively. When one compressor of the regular velocity compressor 120 and the inverter compressor 120' is operated, the check valves 122' prevent the compressed refrigerant generated by a operating compressor from flowing backward into the other compressor that is in a stopped state.

A 4-way valve 124 is connected to the respective oil separators 122 via pipes. The 4-way valve 124 changes a flow direction of the refrigerant according to a cooling or heating operation. Ports of the 4-way valve 124 are connected to respective outlets of the compressors 120 and 120', respective inlets of the compressors 120 and 120', and an indoor unit, respectively. Alternatively, the ports of the 4-way valve 124 may be connected to the oil separators of the compressors 120 and 120' instead of the outlets respectively. Also, the ports of the 4-way valve 124 may be connected to an accumulator of the compressors 120 and 120' instead of the inlets.

A valve support 126 is positioned on a central portion of the front end of the top surface of the base fan 110. The valve support 126 supports and guides an outdoor liquid pipe 210 through which a liquid refrigerant flows, an outdoor gas pipe 212 through which a gaseous refrigerant flows, and a high-low pressure common pipe 214 for maintaining balance of the refrigerant between the outdoor units 100 when a plurality of the outdoor units 100 is provided. A service valve 128 is positioned on the valve support 126. The pipes 210, 212, and 214 supported by the valve support 126 are connected to the indoor unit through pipe inlet/outlet ports 188' of side panels 188.

A supercooler 130 is positioned on a left rear end of the top surface of the base fan 110. The supercooler 130 additionally cools the refrigerant, which is cooled in the outdoor heat-exchanger 180 by heat-exchange. The supercooler 130 may be positioned at a side of the outdoor liquid pipe 210 connected to an outlet side of the outdoor heat-exchanger 180.

Further, a drier is positioned at a side of the outdoor liquid pipe 210. The drier removes moisture contained in the refrigerant flowing into the outdoor liquid pipe 210.

The accumulator 132 is positioned at a central portion of the base fan 110, e.g., between the regular velocity compressor 120 and the inverter compressor 120'. The accumulator 132 filters a liquefied refrigerant to provide a gaseous refrigerant into the compressors 120 and 120'. If the liquefied refrigerant, which is not evaporated into the gas provided from the indoor unit flows into the compressors 120 and 120', the compressors 120 and 120' compressing the refrigerant into the high-pressure and high-temperature vapor refrigerant increase a load. Thus, since the liquefied refrigerant, which is not evaporated, flowing into the accumulator 132 is relatively heavy as compared to the gaseous refrigerant, the liquefied refrigerant is stored in a lower portion of the accumulator 132. Accordingly, the gaseous refrigerant stored in an upper portion of the accumulator 132 flows into the compressors 120 and 120'.

Front frames 134 and 134' are positioned on both sides of the front end of the base fan 110, respectively. For example, the front frames 134 and 134' are vertically positioned on both sides of the front end of the base fan 110. The front frames 134 and 134' are configured to fix the front bracket 116, the front grill 114, and a control box 200.

A center frame 136 is positioned at the center of the outdoor unit 100 in a horizontal direction to fix the front frames 134. Both ends of the center frame 136 are coupled to the front frames 134 and 134', respectively. A barrier 140 is positioned on the center frame 136.

The barrier 140 divides an inner space of the outdoor unit 100 into an upper space and a lower space. For example, the barrier 140 divides an inner space of the outdoor unit 100 into a lower space in which the compressors 120 and 120' are positioned and an upper space in which the outdoor heat-exchanger 180 is positioned. The barrier 140 may be provided in a pair, each including a horizontal part 140' extending backwardly from the center frame 136 and an inclined portion 140" inclinedly extending downwardly from a rear end of the horizontal part 140' at a predetermined angle. An air guide hole 142 is defined in the horizontal part 140' of the barrier 140 as shown in FIG. 1. Air that cools electrical components installed inside the control box 200 flows through the air guide hole 142.

An upper panel 150 defines a top surface of the outdoor unit 100. The upper panel 150 may be provided in a pair, each having a rectangular shape. Discharge holes 152 are defined in the pair of upper panels 150, respectively. A shroud 154 having a cylindrical shape is positioned on a bottom surface of the upper panel 150 corresponding to a circumference of the discharge hole 152. The shroud 154 is substantially integrated with the upper panel 150 to guide air blown by a blow fan 160 to the outside. A discharge grill 156 is positioned on the discharge hole 152.

The blow fan 160 is positioned inside of the shroud 154. The blow fan 160 generates a flow of air circulating into the inside of the outdoor unit 100. That is, when the blow fan 160 is operated, outdoor air is guided into the outdoor unit 100 through the front grill 114. The air is then heat-exchanged with the refrigerant flowing into the outdoor heat-exchanger 180. After the air is heat-exchanged with the refrigerant, the air flows in a downward direction by the operation of the blow fan 160. The air is discharged to outside of the outdoor unit 100 through the discharge hole 152 by the operation of the blow fan 160.

A fan motor 162 is positioned inside the outdoor unit 100, e.g., below the blow fan 160. The fan motor 162 is fixed by the motor mount 164. Front and rear ends of the motor mount 164 are fixed by the front bracket 116 and a rear bracket 194, respectively.

Figure 2:
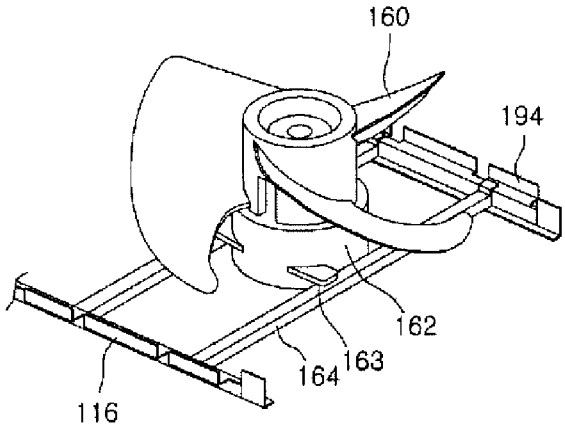
FIG. 2 is a perspective view of a main part.
Figure 3:
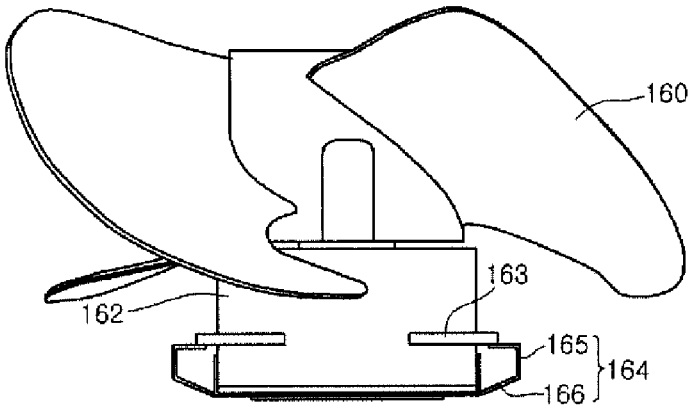
FIG. 3 is a longitudinal sectional view of a main part.

Referring to FIGS. 2 and 3, a plurality of mounting brackets 163 are positioned on the fan motor 162. The mounting brackets 163 fix the fan motor 162 to the motor mount 164. The mounting brackets 163 may be a linkage component such that the fan motor is fix by the motor mount 164. The fan motor 162 may be fixed by a pair of motor mounts 164. The motor mount 164 includes a motor mounting part 165 and an air guide part 166. Both ends of the motor mounting part 165 are fixed by the front bracket 116 and the rear bracket 194, respectively. The air guide part 166 is inclined downwardly from one end of the motor mounting part 165 relatively spaced apart from the fan motor 162 toward the fan motor 162 in a longitudinal direction. For example, the air guide part 166 extends in a longitudinal direction from one end of the motor mounting part 165 so that a flow area of a passage toward an upward direction is increased. Thus, the motor mount 164 has a ⊓-shape in cross-section. The shape of the motor mount 164 may reduce the air flowing by the blow fan 160 from interfering with the motor mount 164.

As shown in FIG. 1, the outdoor heat-exchanger 180 is positioned inside of the outdoor unit 100, e.g., below the upper panel 150. The outdoor heat-exchanger 180 conducts heat-exchange between a refrigerant flowing into the outdoor heat-exchanger 180 and outdoor air. The outdoor heat-exchanger 180 includes a front heat-exchanger 182 positioned below a front end of the upper panel 150 and a rear heat-exchanger 184 positioned below a rear end of the upper panel 150.

A drain pan 186 is positioned below the outdoor heat-exchanger 180. The drain pan 186 collects condensed water generated during heat-exchange between the refrigerant flowing into the outdoor heat-exchanger 180 and the outdoor air. The drain pan 186 also discharges the condensed water to the outside.

The side panels 188 are positioned on both ends of the top surface of the base fan 110. The side panels 188 define lateral outer appearances of the outdoor unit 100. A plurality of inlet/outlet holes 188' are defined in lower portions of the side panels 188.

The rear panel 190 is positioned on a rear end of the base fan 110. The rear panel 190 defines an outer appearance of the outdoor unit 100, for example, a rear lower portion of the outdoor unit 100.

A rear grill 192 is positioned on an upper end of the rear panel 190. The outdoor air to be heat-exchanged with the refrigerant flowing into the outdoor-heat-exchanger 180 is guided into the outdoor unit 110 through the rear grill 192. The air guide in the rear grill 192 is as same as an air guide in the front grill 114. The size of the rear grill 192 may correspond to that of the rear heat-exchanger 184.

The rear bracket 194 is positioned on an upper end of the rear grill 192. The rear bracket 194 is horizontally positioned in a left or a right direction. The motor mount 164 is fixed by the rear bracket 194.

Rear frames 196 are positioned at both sides of the rear end of the base fan 110, respectively. The rear frames 196 are vertically disposed. The rear frames 196 fix the rear grill 192, the rear panel 190, the upper panel 150 and etc.

The control box 200 is positioned on an upper portion of the front panel 112, for example, a rear part of the upper portion. A variety of electrical components for operating the outdoor unit 100 may be installed inside the control box 200. The control box 200 is cooled by air. The barrier 140 guides the air to cool the control box 200. Air that is passed through the air guide hole 142 flows into the control box 200. And the air flowing into the control box 200 cools the electrical components of the control box 200. Then, the air is discharged to the outside of the control box 200. For this discharging operation, an air suction hole and an air discharge hole 202 are defined in the control box 200.

Hereinafter, an operation of the outdoor unit of the air conditioner will be described.

When the air conditioner performs a cooling operation, the gaseous refrigerant from the outdoor unit flows into the accumulator 132 through the 4-way valve 124. The gaseous refrigerant in which a portion of the liquefied refrigerant is filtered while the gaseous refrigerant passes through the accumulator 132 flows into the compressors 120 and 120'.

The gaseous refrigerant flowing into the compressors 120 and 120' is compressed into a high-temperature and high-pressure, and then is transferred into the oil separator 122. Oil contained in the refrigerant transferred into the oil separator 122 is separated to return into the compressors 120 and 120'.

The refrigerant passing through the oil separator 122 flows into the outdoor heat-exchanger 180 through the 4-way valve 124. The refrigerant flowing into the outdoor heat-exchanger 180 is heat-exchanged with the outdoor air guided into the outdoor unit 100 through the front grill 114 and the rear grill 192 by the operation of the blow fan 160 to cool the refrigerant. Also, the refrigerant passing through the outdoor heat-exchanger 180 is additionally cooled while the refrigerant passes through the supercooler 130.

The refrigerant passing through the supercooler 130 passes through the drier for removing the moisture contained therein, and then, passes through the outdoor liquid pipe 210 to flow into the indoor unit. The refrigerant flowing into the indoor unit is heat exchanged with the indoor air while the refrigerant flows into an indoor heat-exchanger positioned inside of the indoor unit to cool the indoor air. Thereafter, the refrigerant flows again into the outdoor unit 100.

The air heat-exchanged with the refrigerant flowing into the outdoor heat-exchanger 180 is moved upwardly by a rotation of the blow fan 160. The air flowing upwardly by the rotation of the blow fan 160 is guided by the guide part 166 to flow into the outside of the motor mount 164, for example, the motor mounting part 165 of the motor mount 164.

Thus, it may reduce a vortex generated when the air flowing by the rotation of the blow fan 160 interferes with the motor mount 164, for example, the motor mounting part 165 of the motor mount 164. The air flowing upwardly by the rotation of the blow fan 160 is discharged to the outside of the outdoor unit 100 through the discharge grill 156.

Hereinafter, another implementation in the air conditioner will be described in detail with reference to FIGS. 4 to 6.

Figure 4:
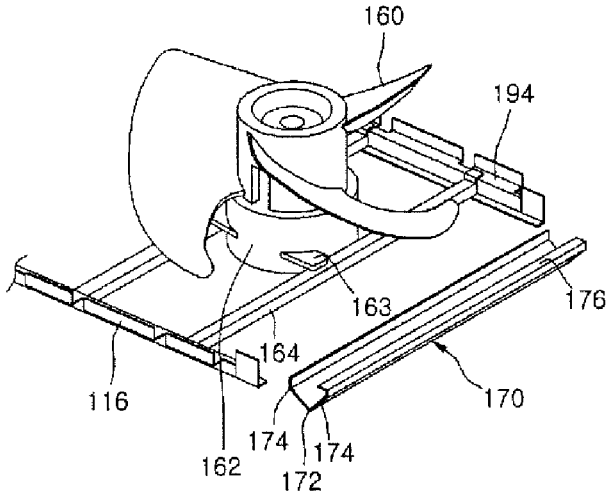
FIG. 4 is an exploded perspective view illustrating an outdoor unit of an air conditioner.
Figure 5:
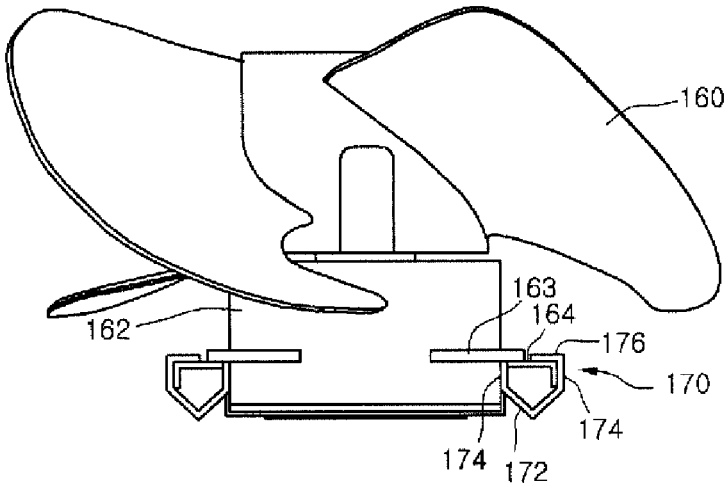
FIG. 5 is a longitudinal sectional view of a main part.

Referring to FIGS. 4 and 5, an air guide 170 reduces a vortex generated when air flows by a rotation of a blow fan 160 and interferes with a motor mount 164. The air guide 170 is detachably disposed on the motor mount 164 on which a fan motor 162 is mounted.

As an example, the air guide 170 includes a guide 172, extending parts 174, and a hook part 176. The guide 172 is bent at a predetermined angle to have a V-shape in cross-section. The guide 172 guides the air flowing by the rotation of the blow fan 160 to reduce a flow of the air from interfering with the motor mount 164. The guide 172 guides the air flowing by the rotation of the blow fan 160 toward the outside of the motor mount 164. The extending parts 174 extend upwardly from both ends of the guide 172, respectively. The hook part 176 extends horizontally from an upper end of the extending parts 174. The hook part 176 is hooked on a top surface of the motor mount 164 in a state where the air guide 170 is mounted on the motor mount 164.

Figure 6:
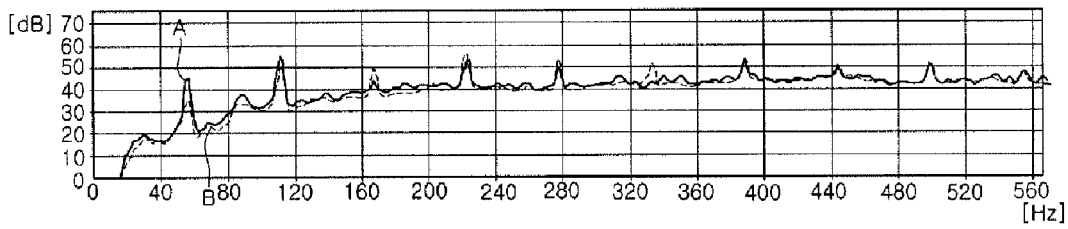
FIG. 6 is a graph illustrating a reduced noise of an outdoor unit of an air conditioner.

Referring to FIG. 6, a curved line A denotes a noise level based on an operation of a related art, and a curved line B denotes a noise level based on an operation of the present disclosure.

In some examples, the air guide may be fixed to the motor mount with using a separate coupling member such as a screw.

Since the interference between the outdoor air flowing by the blow fan and the motor mount can be reduced, the noise generated when the outdoor air flowing by the blow fan is heat exchanged with the refrigerant may be reduced.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An air conditioner, comprising:

a heat-exchanger positioned in an outdoor unit and configured to conduct heat-exchange between air provided from outside of the outdoor unit and a refrigerant;

a fan configured to generate a flow of the air that is from the heat-exchanger to an outlet of the outdoor unit;

a driving unit configured to provide a driving force to the fan;

a first member positioned in the flow of the air generated by the fan;

a second member configured to guide a flow path of the air to reduce collision between the air and the first member when the fan is operated;

a plurality of first members that include the first member; and a plurality of second members coupled to the plurality of first members, respectively, the plurality of second members including the second member and being configured to guide a flow path of the air to reduce collision between the air and the plurality of first members.

2. The air conditioner of claim 1, wherein the second member is integrated with the first member.

3. The air conditioner of claim 1, wherein the first member comprises a motor mount on which the driving unit is mounted.

4. The air conditioner of claim 1, wherein the second member is detachable and positioned on the first member.

5. The air conditioner of claim 1, wherein the second member is configured to change a flow path of air circulated by the fan.

6. The air conditioner of claim 1, wherein the second member comprises:

a guide part; and a hook part configured to be hooked on the first member.

7. The air conditioner of claim 1, wherein the second member comprises:

a guide part having a V-shape;

an extending part extending from a side of the guide part; and a hook part extending from a side of the extending part and configured to be hooked on the first member.

8. The air conditioner of claim 1, further comprising:

a cooler configured to cool the refrigerant provided from the heat-exchanger.

9. The air conditioner of claim 1, further comprising:

a drain member configured to collect condensed water resulting from the heat exchange performed by the heat-exchanger.

10. An air conditioner, comprising:

a heat-exchanger positioned in an outdoor unit and configured to conduct heat-exchange between air provided from outside of the outdoor unit and a refrigerant;

a fan positioned above the heat-exchanger and configured to generate a flow of the air in which the air is flowed up toward an outlet of the outdoor unit of the air conditioner;

a driving unit configured to provide a driving force to the fan;

a first member positioned in the flow of the air generated by the fan;

a second member configured to guide a flow path of the air to reduce collision between the air and the first member when the fan is operated;

a plurality of first members that include the first member; and a plurality of second members coupled to the plurality of first members, respectively, the plurality of second members including the second member and being configured to guide a flow path of the air to reduce collision between the air and the plurality of first members.

11. The air conditioner of claim 10, wherein the second member is integrated with the first member.

12. The air conditioner of claim 10, wherein the first member comprises a motor mount on which the driving unit is mounted.

13. The air conditioner of claim 10, wherein the second member is detachable and positioned on the first member.

14. The air conditioner of claim 10, wherein the second member comprises:

a guide part; and a hook part configured to be hooked on the first member.

15. The air conditioner of claim 10, wherein the second member comprises:

a guide part having a V-shape; and an extending part extending from a side of the guide part.

16. The air conditioner claim 10, further comprising:

a cooler configured to cool the refrigerant provided from the heat-exchanger.

17. The air conditioner of claim 10, further comprising:

a drain member configured to collect condensed water resulting from the heat-exchange performed by the heat-exchanger.

* * * * *